US005950237A

United States Patent [19]

Micheron et al.

[11] Patent Number: 5,950,237

[45] Date of Patent: Sep. 14, 1999

[54] JACKET FOR THE PERSONAL PROTECTION OF AN INFANTRYMAN

[75] Inventors: François Micheron, Gif Sur Yvette; Gérard Berginc, Thiais; Frank Normand, Les Molieres, all of France

[73] Assignee: Thomson-CSF, Paris, France

[21] Appl. No.: 08/886,151

[22] Filed: Jun. 30, 1997

[30] Foreign Application Priority Data

Jun. 28, 1996 [FR] France ..... 96 08080

[51] Int. Cl.[6] ..... A41D 13/00; H01Q 17/00

[52] U.S. Cl. ..... 2/69; 2/2.5; 2/97; 2/410; 2/900; 342/3; 342/4

[58] Field of Search ..... 2/2.5, 456, 93, 2/69, 94, 97, 900, 905, 410, 412; 342/3, 4; 428/911, 919

[56] References Cited

U.S. PATENT DOCUMENTS

| | | | |
|---|---|---|---|
| 3,349,396 | 10/1967 | Reed . | |
| 3,349,397 | 10/1967 | Rosenthal | 342/4 |
| 3,453,620 | 7/1969 | Fleming et al. | 342/4 |
| 3,479,510 | 11/1969 | Baumberger et al. . | |
| 3,782,802 | 1/1974 | Micheron et al. . | |
| 3,847,465 | 11/1974 | Micheron et al. . | |
| 3,892,465 | 7/1975 | Micheron et al. . | |
| 3,940,201 | 2/1976 | Micheron et al. . | |
| 3,961,837 | 6/1976 | Bied-Charreton et al. . | |
| 3,978,458 | 8/1976 | Vergnolle et al. . | |
| 4,001,827 | 1/1977 | Wallin et al. | 342/4 |
| 4,024,513 | 5/1977 | Huignard et al. . | |
| 4,034,375 | 7/1977 | Wallin | 342/4 |
| 4,055,838 | 10/1977 | Huignard et al. . | |
| 4,063,795 | 12/1977 | Huignard et al. . | |
| 4,065,671 | 12/1977 | Mayeux et al. . | |
| 4,065,677 | 12/1977 | Micheron et al. . | |
| 4,092,494 | 5/1978 | Micheron . | |
| 4,124,268 | 11/1978 | Micheron et al. . | |
| 4,138,189 | 2/1979 | Huignard et al. . | |
| 4,163,162 | 7/1979 | Micheron . | |
| 4,176,345 | 11/1979 | Micheron et al. . | |
| 4,205,242 | 5/1980 | Micheron et al. . | |
| 4,227,082 | 10/1980 | Mayeux et al. . | |
| 4,244,030 | 1/1981 | Albarello . | |
| 4,284,921 | 8/1981 | Lemonon et al. . | |
| 4,327,153 | 4/1982 | Micheron . | |
| 4,345,359 | 8/1982 | Micheron . | |
| 4,346,505 | 8/1982 | Lemonon et al. . | |
| 4,354,134 | 10/1982 | Micheron . | |
| 4,368,386 | 1/1983 | Huignard et al. . | |
| 4,369,391 | 1/1983 | Micheron . | |
| 4,384,394 | 5/1983 | Lemonon et al. . | |
| 4,400,634 | 8/1983 | Micheron . | |
| 4,401,911 | 8/1983 | Ravinet et al. . | |
| 4,403,382 | 9/1983 | Facoetti et al. . | |
| 4,419,598 | 12/1983 | Spitz et al. . | |
| 4,419,599 | 12/1983 | Micheron . | |
| 4,427,609 | 1/1984 | Broussoux et al. . | |
| 4,440,388 | 4/1984 | Divoux et al. . | |
| 4,442,162 | 4/1984 | Kuester . | |
| 4,500,377 | 2/1985 | Broussoux et al. . | |
| 4,508,668 | 4/1985 | Broussoux et al. . | |

FOREIGN PATENT DOCUMENTS

| | | |
|---|---|---|
| 2 543 286 | 9/1984 | France . |
| 3 507 889 | 9/1986 | Germany . |
| 2 026 660 | 2/1980 | United Kingdom . |

*Primary Examiner*—Michael A. Neas
*Attorney, Agent, or Firm*—Oblon, Spivak, McClelland, Maier & Neustadt, P.C.

[57] ABSTRACT

The disclosed jacket comprises a layer that is discreet with respect to the visible and infrared frequencies, having a specified thickness, with a specified dielectric permittivity and emissivity close to 1 for the infrared frequency bands considered; a resistive layer, with an electrical resistivity and thickness that are determined so that the inverse of their product gives a specified resistance; a layer of dielectric material with a specified thickness and a specified dielectric permittivity; and a conductive layer with electrical conductivity determined so that it is considered as a reflective plane for the radar frequencies considered.

16 Claims, 2 Drawing Sheets

U.S. PATENT DOCUMENTS 4,518,555 5/1985 Ravinet et al. .
4,521,322 6/1985 Broussoux et al. .
4,535,205 8/1985 Ravinet et al. .
4,607,145 8/1986 Ravinet et al. .
4,649,312 3/1987 Robin et al. .
4,670,074 6/1987 Broussoux et al. .
4,708,989 11/1987 Broussoux et al. .
4,734,228 3/1988 Micheron et al. .
4,782,227 11/1988 Micheron et al. .
4,812,647 3/1989 Broussoux et al. .
4,818,857 4/1989 Micheron et al. .
4,818,877 4/1989 Ayrai et al. .
4,856,042 8/1989 Staron et al. .
4,873,455 10/1989 De Chambost et al. .
4,945,916 8/1990 Kretschmer et al. .
5,003,311 3/1991 Roth et al. ..... 342/4
5,214,716 5/1993 Refregier et al. .
5,440,400 8/1995 Micheron et al. .
5,472,769 12/1995 Goerz, Jr. et al. .
5,627,374 5/1997 Couderc et al. .
5,708,435 1/1998 Kudo et al. ..... 342/4

JACKET FOR THE PERSONAL PROTECTION OF AN INFANTRYMAN

BACKGROUND OF THE INVENTION

The invention relates to a jacket for the personal protection of an infantryman or foot-soldier, compatible with anti-shrapnel protection, and enabling a reduction of the infantryman's radar and infrared signature.

The field of application of the present invention relates to jackets for the personal protection of infantrymen in operation on a battlefield.

Personal protection is based today solely on protection against shrapnel from projectiles, discretion in the field of the visible frequencies and NBC (nuclear, biological and chemical) protection.

For providing anti-shrapnel protection, there are known ways of using metal structures. This approach is being increasingly replaced by one that uses composite structures based on aramide or polyamide fibers.

The two regions of the human body to be protected are the head by means of a helmet and the trunk by means of a vest. As for the reduction of the signature in the domain of the visible frequencies, this form of protection relies chiefly on a conventional type of disruptive or camouflage painting. This camouflage painting may be made on a fabric and have a 2D appearance on a fabric or it may be on a camouflage net and have a 3D appearance.

During a mission of penetration behind enemy lines, the infantryman may be faced with a threat of radar and/or infrared detection. The type of radar threat considered in the present invention is a two-fold threat: a first threat comes from a battlefield monitoring radar working typically at about 10 GHz and a second threat comes from a target-designation radar working typically in the 36 to 37 GHz band. These two types of radar have a range of about 10 to 20 km. The range of the first type is about 7 km for an individual and about 15 km for a vehicle. As for the second type of radar, it is more specifically used for the designation of vehicles but is sometimes a real threat to infantrymen.

Presently known systems of personal protection for infantrymen cannot be used to protect them against such threats.

SUMMARY OF THE INVENTION

The invention is aimed at overcoming the above-mentioned drawbacks.

To this end, an object of the invention is a jacket for the personal protection of an infantryman, compatible with anti-shrapnel protection, and enabling a reduction of the infantryman's radar and infrared signature, said jacket comprising a stack of layers of materials that are isotropic and homogeneous at the frequencies considered, absorbing the radar electromagnetic waves received by the jacket, the stack comprising the following starting from its outermost layer:

- a layer that is discreet with respect to the visible and infrared frequencies, having a specified thickness, with a specified dielectric permittivity and emissivity close to 1 for the infrared frequency bands considered;
- a resistive layer, with an electrical resistivity and thickness that are determined so that the inverse of their product gives a specified resistance;
- a layer of dielectric material with a specified thickness and a specified dielectric permittivity; and
- a conductive layer with electrical conductivity determined so that it is considered as a reflective plane for the radar frequencies considered;

- the thickness and the resistivity of the resistive layer as well as the thickness and the electromagnetic properties of the dielectric layer being adapted to optimize the destructive interaction between the reflections and numerous transmissions created at the interfaces of each of the layers of the jacket so that this jacket appears on the whole with respect to the exterior as an absorbent material for the frequency bands considered.

The jacket according to the invention is used in particular for the X and Ka radar frequency bands as well as in the II and III bands of the infrared.

The invention also relates to an infantryman's battledress made from a jacket comprising:

- a first jacket part covering the infantryman's helmet and the trunk; the dielectric layer of the jacket being made of a substantially rigid dielectric material to provide for anti-shrapnel protection;
- a second jacket part covering the infantryman's lower and upper limbs; the dielectric layer of the jacket being made of a flexible dielectric material with dielectric properties close to those of the substantially rigid dielectric material, providing for the mobility of the infantryman's upper and lower limbs.

The present invention has the advantage of proposing a jacket structure for an infantryman compatible with military use, namely a jacket structure that is impermeable, flexible, resistant, enabling a reduction of the radar and infrared signature while at the same time remaining compatible with protection against shrapnel from shells, mines, etc.

This structure may be appropriately used to cover a helmet as well as an item of clothing, the only difference between these two applications being the overall flexibility of the two structures with a flexible structure for the clothing and a rigid structure for the helmet.

BRIEF DESCRIPTION OF THE DRAWINGS

Other features and advantages of the present invention shall appear more clearly from the following description and the appended figures, of which.

DETAILED DESCRIPTION OF THE INVENTION

The radar threat considered comes from a battlefield surveillance type of surveillance radar coupled to a target-designation radar. The infrared threat considered relates to the bands II and III of the infrared range respectively corresponding to the 3 to 5 $\mu$m and 8 to 12 $\mu$m wavelengths.

Infrared discretion, in view of the passive character of the jacket, is based chiefly on a highly efficient heat screen that reduces heat transfer in both directions to the minimum and is also based on an adjustment of the emissivity of the jacket with respect to that of the environment.

The heat screen thus made can be used to prevent the outward transfer of heat, which an essential factor for infrared detection, but can also be used to prevent the transfer of heat towards the interior. In the case of an infantryman, this considerably reduces internal heating which represents a major factor of comfort for an infantryman.

Visible discretion is based on the camouflage painting of the external surface of the jacket or on the use of a net with camouflage painting that gives the entire dress a 3D effect. These known approaches are quite standard.

Radar discretion is chiefly obtained by the absorption of the energy from the electromagnetic waves received by the jacket. The phenomenon of scattering created by the jacket used for the visible discretion can be used, as the case may be, to further improve the level of performance.

Figure 1:
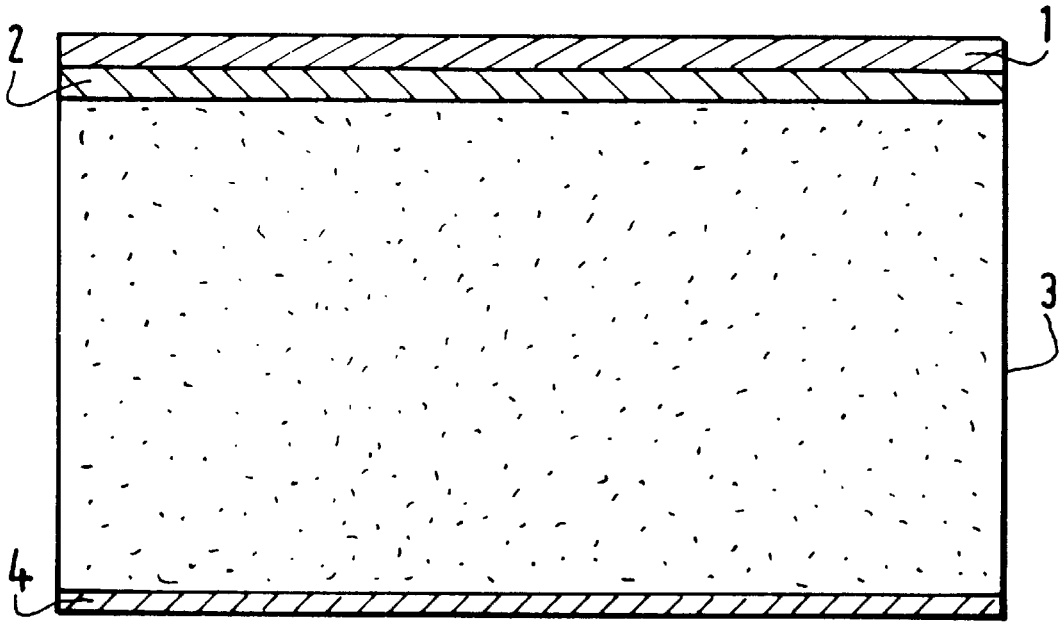
FIG. 1 shows a cross-sectional view of a jacket according to the invention.

FIG. 1 illustrates a cross-sectional drawing of a jacket according to the invention.

The jacket according to the invention is formed by a stack of four successive layers 1 to 4. The definition of each of these layers given here below by way of a non-restrictive example represents an optimum solution for the reduction of the radar signature in the frequency bands considered.

The definition of each of these layers 1 to 4 is given here below, starting from the outermost layer 1 of the jacket.

The first layer 1 has several functions: it forms a screen against bad weather conditions and is formed for example by an impermeable and resistant film with a small thickness of about 150 $\mu$m. This layer 1 may be made of a PVC (polyvinylchloride) film. This screen can also be used to reduce the infrared and visible signature for this first layer 1, which is the outermost layer, is covered with a 2D or 3D camouflage painting with emissivity close to 1 for the infrared frequency bands considered.

Furthermore, in thermal terms, the non-negligible thickness of the jacket according to the invention, which is about 4 mm, provides for excellent thermal properties ensuring thermal insulation between the body and the exterior of the jacket. This condition is obligatory for any structure designed to reduce the passive infrared signature.

The layer 2 is a resistive layer. Its role is to create the most efficient possible compromise between the reflections and numerous transmissions created at the interfaces of each of the layers 1 to 4 of the jacket to provide for the most efficient destructive interaction possible when the jacket receives an electromagnetic wave.

The thickness and resistivity of this layer 2 are adapted to optimize the destructive interactions so that the jacket according to the invention appears on the whole as an absorbent material for the frequency bands considered.

The thickness of the layer 2 is about 200 $\mu$m. Its electrical conductivity and its thickness are adapted so that the inverse of their product, which represents a resistance, to be close to 330 Ω.

Typically, this resistive layer is made of a carbon-charged textile fiber.

The layer 3 is a layer made of substantially rigid dielectric material comprising a thickness and mechanical properties that also provide anti-shrapnel protection, for example a material such as an aramide, a polycarbonate or the like.

This layer 3 also enables the fixing of the radar frequency bands absorbed by destructive interference. The energy values brought into play in this case are low, and therefore no rise in temperature that could harm the infrared discretion is observed.

The layer 4 is a reflective layer with electrical conductivity tending towards infinity, generally greater than or equal to $10^4\Omega^{-1}.m^{-1}$, which corresponds to a surface resistance ranging from some Ω to some tens of Ω as a function of the thickness of the layer 4. It defines the reference reflective plane of the jacket according to the invention. It is formed for example by an aluminum film with a thickness of about 50 $\mu$m.

The distance between this reference plane and the rest of the jacket, namely the stack of the different layers 1 to 4 described here above is determined and fixed in order to achieve the desired optimization.

The materials referred to here above must be isotropic and homogeneous at the frequencies considered. These conditions are necessary because of the theories on which the optimization is based. It is assumed that the characteristics which are not specified are any characteristics.

The jacket according to the invention is compatible with anti-shrapnel protection. Either the structure providing for anti-shrapnel protection comes within the definition of the radar-absorbent screen at the layer 3 formed by the dielectric material or it does not come within the definition of the radar screen and, in the latter case, it is placed behind the reflective plane formed by the layer 4 which is the innermost layer of the jacket.

The different layers 1 to 4 and their characteristics that have just been defined are given here below in the form of a summary table called Table 1.

TABLE 1

| Layers | Characteristics of the layer |
|---|---|
| 1 | Impermeable dielectric material with permittivity of 2.85 for the real part, thickness of 150 $\mu$m (for example a PVC film) |
| 2 | Material with a resistance of 330 Ω equal to the inverse of the product of the electrical conductivity and the thickness (for example thickness of 200 $\mu$m and 15 $\Omega^{-1} \cdot m^{-1}$) (for example carbon-charged polyamide fiber) |
| 3 | Dielectric permittivity of 3.2 and thickness of 3.4 mm (for example aramide fabric) |
| 4 | Electrical conductivity that may be considered as being infinite $10^8\ \Omega^{-1} \cdot m^{-1}$, and thickness at least equal to some microns (for example aluminum film) |

Figure 2:
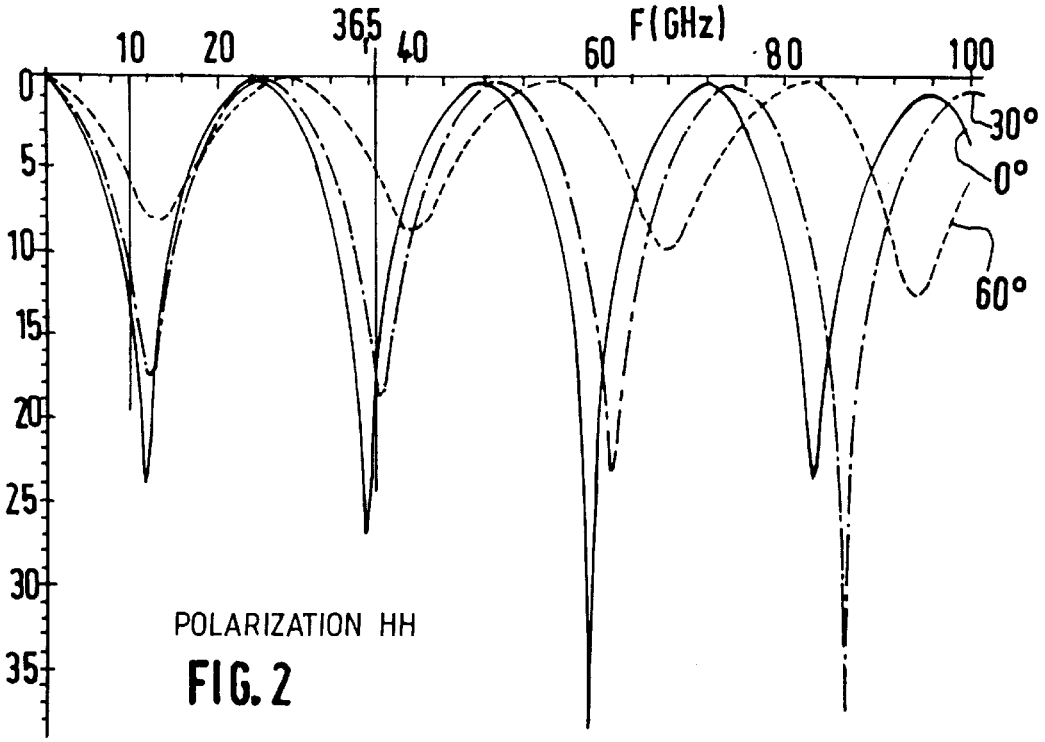
FIGS. 2 and 3 show curves illustrating the evolution of the coefficient of specular reflection in power for three angles of incidence, 0°, 30° and 60°, respectively for the HH and VV polarizations of the incident electromagnetic waves.
Figure 3:
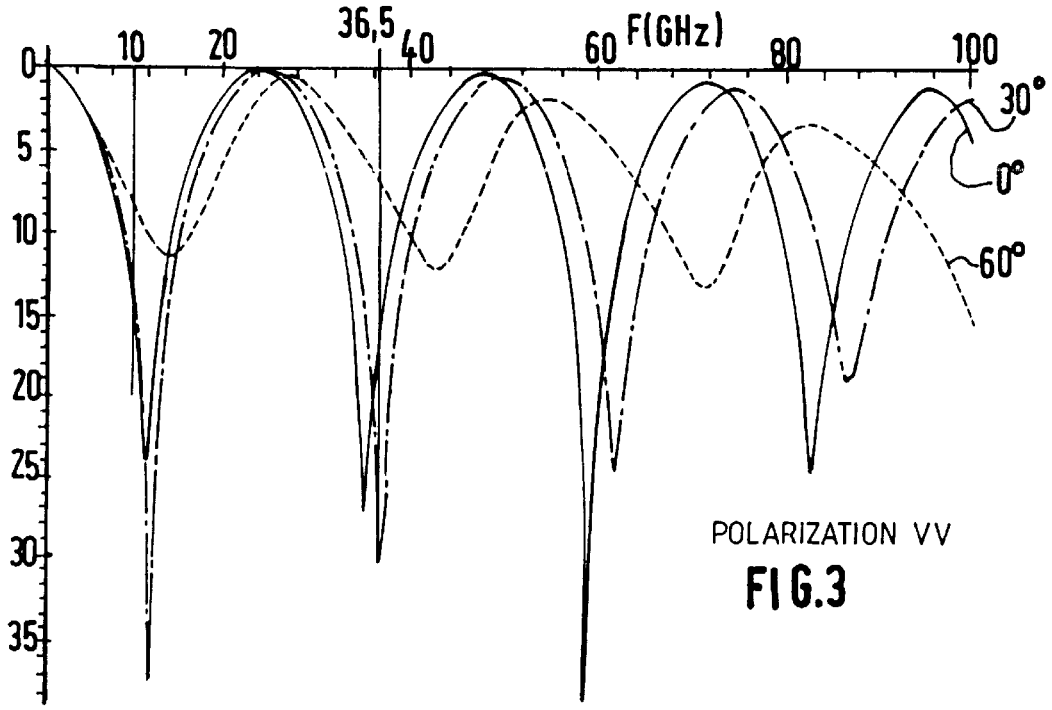

FIGS. 2 and 3 illustrate the evolution of the coefficient of specular⁻ reflection in power in dB for the jacket according to the invention as defined here above, for three angles of incidence 0°, 30° and 60° respectively for the HH and VV polarizations. HH and VV respectively signify a horizontal-horizontal polarization and a vertical-vertical polarization of the electromagnetic wave. The former term corresponds to the polarization of the incident wave and the latter term to that of the reflected wave. The computation is based on the conditions of passage through a diopter.

The values of the specular reflection coefficient in dB for the three angles of incidence 0°, 30° and 60° for the HH and VV polarizations and for the frequencies 10 GHz and 36.5 GHz corresponding to the mean value of the passband of the target-designation radar are given in the following Table 2:

TABLE 2

| Angle of | HH polarization | | VV polarization | |
|---|---|---|---|---|
| incidence | 10 GHz | 36.5 GHz | 10 GHz | 36.5 GHz |
| 0° | −13 | −20 | −13 | −20 |
| 30° | −11 | −20 | −13 | −20 |
| 60° | −6 | −6 | −8 | −7 |

The values in terms of incidence are given purely by way of an indication for, in an application of this kind where the shape of the target is a simple one, only the value in terms of normal incidence is truly representative of the reduction of the radar signature of the target.

The following Table 3 illustrates the range of values in which the given characteristics may vary while at the same time providing for a value of coefficient of specular reflection in normal incidence from −10 dB for the two radar bands considered, 10 Ghz and 36–37 GHz, for a surface resistance of about 330 Ω for the layer 2.

TABLE 3

| Layer | (Real) permittivity | Electrical conductivity ($\Omega^{-1} \cdot m^{-1}$) | Thickness |
|---|---|---|---|
| 1 | 1–8 | — | <650 μm |
| 2 | — | $9–10^8$ | <320 μm |
| 3 | 2.4–3.6 | 0–1 | 3.1–3.6 mm |

A mean typical thickness of a jacket according to the invention is less than or equal to about 4 mm. The increase in the mass of the jacket related to the properties of the reduction of SER (surface equivalent radar) is negligible as compared with the mass of the basic jacket, for a minimum initial mass is required for anti-shrapnel protection.

In keeping the performance characteristics of reduction of the SER of the jacket according to the invention, a gain in mass may be obtained, for example by replacing the aramide that constitutes the material of the layer 3 by a less dense textile made of PVC for example. However, in this case, the anti-shrapnel protection is no longer ensured.

The performance characteristics of a jacket according to the invention are given here below by way of a non-restrictive example. Given the simple shape of the human body, it may be assumed that it behaves like a plane or even convex structure (with no dihedral or trihedral effect) with respect to electromagnetic waves.

Starting from this approximation, it is possible, on the basis solely of the value of the coefficient of specular reflection in normal incidence at 10 GHz, to deduce the reduction of range of a battlefield surveillance type radar. The range of this radar, for a human target, goes from 7 km to 3.3 km.

Starting from the principle that it is only the infantryman's trunk and head, or more generally his vital parts, that need to be protected against shrapnel, a jacket according to the invention can be applied to the making of a battledress that protects him against shrapnel and other projectiles.

Figure 4:
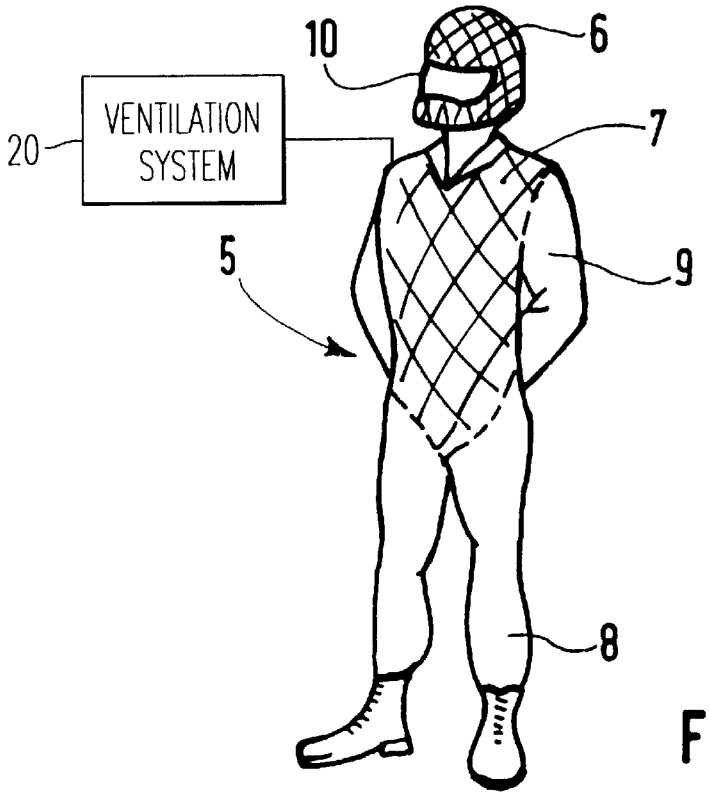
FIG. 4 shows an infantryman's battledress made out of a jacket according to the invention.

FIG. 4 illustrates an infantryman 5 wearing a battledress made from a jacket according to the invention.

According to this principle, the third dielectric layer 3 of the jacket according to the invention covering the helmet 6 and forming the vest 7 of the battledress is made out of a material such as aramide, polycarbonate or the like. This dielectric layer can either be attached to the helmet or form an integral part of the helmet.

The protection zones set up by the vest can be extended so as to stretch over to the limbs without in any way hindering the movements of the infantryman in operation.

The third dielectric layer 3 of the jacket covering the lower limbs 8 and upper limbs 9 is made of a more flexible dielectric material such as a fabric whose dielectric properties are close to those of the aramide.

A battledress as described here above must be designed so as not to hamper the movements of the infantryman 5 in operation.

The battledress may be furthermore fitted out with a system of ventilation 20 by forced-air or natural convection.

The helmet 6 covered with a jacket according to the invention may be furthermore provided with a visor 10 that is transparent for the frequencies of the visible range, bearing anti-laser filters that are reflective for the infrared wavelengths and processed to minimize the surface equivalent radar. The helmet 6 is furthermore shaped so as to have facets that prohibit specular reflection in the directions of radar incidence.

Finally, the entire battledress may be made impermeable to toxic products used on the battlefield. It is the first external layer 1 that is given this role.

What is claimed is:

1. A jacket for the personal protection of an infantryman, comprising:

an outermost layer that is discreet with respect to specified visible and infrared frequencies, having a specified thickness, with a specified dielectric permittivity and emissivity close to 1 for the specified infrared frequencies;

a resistive layer, inward from said outermost layer, with an electrical resistivity and thickness that are determined so that the inverse of their product gives a specified resistance;

a layer of dielectric material inward from said resistive layer, with a specified thickness and a specified dielectric permittivity; and a conductive layer inward from said layer of dielectric material, with electrical conductivity determined so that it is considered as a reflective plane for specified radar frequencies;

wherein the thickness and the resistivity of the resistive layer as well as the thickness and the electromagnetic properties of the dielectric layer being adapted to optimize the destructive interaction between the numerous reflections and transmissions created at the interfaces of each of the layers of the jacket so that this jacket appears, on the whole, with respect to the exterior as an absorbent material for specified radar frequency bands considered.

2. A jacket according to claim 1, wherein the layer that is discreet with respect to the visible and infrared frequencies comprises a 2D or 3D camouflage painting with emissivity close to 1 for the infrared frequency bands.

3. A jacket for the personal protection of an infantryman, comprising:

an outermost layer that is discreet with respect to specified visible and infrared frequencies, having a specified thickness, with a specified dielectric permittivity and emissivity close to 1 for the specified frequencies;

a resistive layer, inward from said outermost layer, with an electrical resistivity and thickness that are determined so that the inverse of their product gives a specified resistance;

a layer of dielectric material, inward from said resistive layer, with a specified thickness and a specified dielectric permittivity; and a conductive layer, inward of said layer of dielectric material, with electrical conductivity determined so that it is considered as a reflective plane for specified radar frequencies;

wherein the thickness and the resistivity of the resistive layer as well as the thickness and the electromagnetic properties of the dielectric layer being adapted to optimize the destructive interaction between the numerous reflections and transmissions created at the interface of each of the layers of the jacket so that this jacket appears, on the whole, with respect to the exterior as an absorbent material for specified radar frequency bands.

4. A jacket according to claim 3, wherein the layer that is discreet with respect to the visible and infrared frequencies has a thickness ranging between a thickness close to 0 and about 650 $\mu$m and a complex dielectric permittivity in the two bands whose real part ranges from about 1 to 8.

5. A jacket according to claim 3, wherein the resistive layer has a thickness and an electrical conductivity determined so that the surface resistance of the layer is equal to about 330 Ω.

6. A jacket according to claim 3, wherein the layer of dielectric material has a thickness ranging from about 3.1 to 3.6 mm, an electrical conductivity ranging from about 0 to 1 $\Omega^{-1}.m^{-1}$; and a complex permittivity whose real part ranges from about 2.4 to 3.6.

7. A jacket according to claim 6, wherein the layer that is discreet with respect to the visible and infra-red frequencies comprises a 2D or 3D camouflage painting with emissivity close to 1 for the I and II infrared bands.

8. A jacket for an infantryman, comprising:

an outermost layer of impermeable dielectric material with a complex permittivity whose real part is equal to about 2.85, and with a thickness equal to about 150 $\mu$m;

a- resistive layer, inward of said outermost layer, with resistance equal to about '330 Ω and corresponding to the inverse of the product of electrical conductivity equal to about 15 $\Omega^{-1}.m^{-1}$ and with a thickness equal to 200 $\mu$m;

a layer of dielectric material, inward of said resistive layer, with complex dielectric permittivity whose real part is equal to about 3.2 and with a thickness equal to about 3.4 mm; and a conductive layer, inward of said layer of dielectric material with a thickness and with electrical conductivity that may be considered to be infinite; the thickness and the electromagnetic properties of the dielectric layer being adapted to optimize the numerous reflections and transmissions created at the interfaces of each of the layers of the jacket so that this jacket appears on the whole with respect to the exterior as an absorbent material for specified frequency bands.

9. A jacket according to claim 8, wherein:

the layer of impermeable dielectric material is discreet with respect to the visible and infrared frequencies and is a PVC film, the resistive layer is a carbon-charged polyamide fabric;

the layer of dielectric material is an aramide fabric, and the conductive layer is an aluminium film.

10. A jacket according to claim 9, wherein the PVC layer comprises a 2D or 3D camouflage painting with emissivity close to 1 for the infrared frequency bands.

11. A jacket according to claim 9, wherein the PVC layer is covered with a net made of PVC with camouflage painting using polyurethane paint.

12. An infantryman's battledress made out of a jacket comprising:

an outermost layer that is discreet with respect to specified visible and infrared frequencies, having a specified thickness, with a specified dielectric permittivity and emissivity close to 1 for the specified infrared frequencies;

a resistive layer, inward of said outermost layer, with an internal electrical resistivity and thickness that are determined so that the inverse of their product gives a specified resistance;

a layer of dielectric material, inward of said outermost layer, with a specified thickness and a specified dielectric permittivity;

a conductive layer, inward of said layer of dielectric material, with electrical conductivity determined so that it is considered as a reflective plane for specified the radar frequencies;

a first jacket part covering an infantryman's helmet and the trunk, dielectric layer of the jacket being made of a substantially rigid dielectric material possessing a thickness and mechanical properties that are determined to provide for anti-shrapnel protection; and a second jacket part covering the infantryman's lower and upper limbs; the dielectric layer of the jacket being made of a flexible dielectric material with dielectric properties close to those of the substantially rigid dielectric material, providing for the mobility of the infantman's upper- and lower limbs;

wherein the thickness and the resistivity of the resistive layer as well as the thickness and the electromagnetic properties of the dielectric layer being adapted to optimize the destructive interaction between the numerous reflections and transmissions created at the interfaces of each of the layers of the jacket, so that this jacket appears on the whole with respect to the exterior as an absorbent material for the specified frequencies.

13. A battledress according to claim 12, wherein the substantially rigid dielectric material is aramide and wherein the flexible dielectric material is PVC.

14. A battledress according to claim 12, fitted out with a system of ventilation by forced-air or natural convection.

15. A battledress according to claim 12, the helmet comprising facets prohibiting specular reflection in the directions of radar incidence, and comprising a visor that is transparent for the visible frequencies, bearing anti-laser filters that are reflective for the infrared frequencies and are treated to minimize the surface equivalent laser.

16. A battledress according to claim 12, wherein the external surface of the battledress corresponding to the first layer of the jacket is made impermeable to the toxic products habitually used on a battlefield.

* * * * *